United States Patent [19]

Boire et al.

[11] Patent Number: 4,749,969

[45] Date of Patent: Jun. 7, 1988

[54] 180° HYBRID TEE

[75] Inventors: Daniel C. Boire, Ferndale; James E. Degenford, Ellicott City, both of Md.

[73] Assignee: Westinghouse Electric Corp., Pittsburgh, Pa.

[21] Appl. No.: 75,190

[22] Filed: Jul. 17, 1987

Related U.S. Application Data

[63] Continuation of Ser. No. 765,478, Aug. 14, 1985, abandoned.

[51] Int. Cl.[4] ..... H01P 5/22

[52] U.S. Cl. ..... 333/120; 333/246; 333/121

[58] Field of Search ..... 333/120, 121

[56] References Cited

U.S. PATENT DOCUMENTS 4,578,652 3/1986 Sterns ..... 333/120 X

*Primary Examiner*—Paul Gensler

*Attorney, Agent, or Firm*—W. G. Sutcliff

[57] ABSTRACT

A hybrid ring structure 180° phase shifting apparatus or device capable of taking a single electrical input signal of predetermined frequency, splitting said signal into two isolated independent output signals utilizing engraving upon the substrate on one side only wherein said device is fully operable and compatible to operate in hybrid micro-electronic functions.

23 Claims, 6 Drawing Sheets

180° HYBRID TEE

This application is a continuation of application Ser. No. 765,478 filed Aug. 14, 1985, now abandoned.

BACKGROUND OF THE INVENTION

1. Field of the Invention

The present invention relates to a 180° phase-shifting, signal-splitting device engraved on one side of an insulating or semi-insulating substrate suitable for interface with hybrid micro-electronic structures.

2. Description of the Prior Art

A "rat race", FIG. 1A, has been described as a circular loop of coaxial line closed upon itself and having four branching connections. It has essentially the same properties of what is also called electronically a magic tee. In the case of the most commonly used type of "rat race", the coaxial loop has a circumference of 1.5 wavelengths. One $\frac{3}{4}$ wavelength spacing between connections is employed and the other three spacings are made of $\frac{1}{4}$ wavelength in length. In a properly matched "rat race" operating at the correct frequency, several useful affects are achieved. Energy entering the rat race from arm 1 is evenly split between arms 3 and 4 and no power reaches arm 2. A wave entering the rat race at arm 3 is evenly split between arms 1 and 2 and no power reaches arm 4. To use the rat race as a transmitter/receiver duplexer, the transmitter is connected to arm 3, the antenna to arm 1 and the receiver to arm 4 and a match load to arm 2. During transmission, no energy reaches the receiver. During reception, energy from the antenna is fed to the receiver. A three dB loss occurs during both transmit and receive periods but this loss is shown to be unavoidable in any passive network duplexer. In some millimeter wavelength applications, rectangular or circular waveguides may replace coaxial lines in "rat races".

Hybrid ring "rat race" couplers have been used extensively in microwave circuit applications. However, the large size and narrow band performance of the "rat race" precluded its use in many modern microwave circuit applications especially in monolithic microwave integrated circuits (MMICs). The present invention defines a broadband, reduced size, 180°, three dB hybrid ring coupler suitable for both monolithic and hybrid microwave circuit applications. This coupler theoretically maintains a 180° transmission phase difference and perfect isolation between the two output ports independent of the input frequency.

In June, 1968 on IEEE Transactions on Microwave Theory and Techniques Article entitled "A Wideband Strip Line Hybrid Ring" by Steven March disclosed a narrow band device, a "rat race" hybrid that can be broadbanded for good performance over an octave by incorporating several design changes. The limiting factor in the usual hybrid ring coupler is the $\frac{3}{4}$ wavelength section which restricts the useful frequency range for the 180° hybrid to $F \pm 0.23F$ where F is the center frequency in the band of interest. A conventional ring configuration exhibits a $-3$ dB of coupling when the characteristic impedance of each ring segment Z is $2Z_0$ where $Z_0$ is the characteristic impedance of both the input and output lines. The March device realized a decreased frequency sensitivity by replacing the $\frac{3}{4}$ wavelength section by one having the same mid-band impedance, but whose electrical length is realized by a $\frac{1}{4}$ wavelength of line exhibiting the characteristics of an ideal phase reversing network. A pair of equilateral broadside coupled segments of strip transmission line having diametrically opposed ends short circuited approximates a phase reversing network over a wide frequency range. The use of this configuration in a magic tee is one example. The March device is somewhat frequency insensitive. However, the length of the segments between the four ports is determined by the frequency of the input signal. If the frequency of the input signal is the determining factor in the length of each of the arcuate segments between each port, then the device is size constrained.

The problem to be solved is the production of a hybrid microelectronically compatible 180° phase shifting structure which is frequency insensitive and is frequency independent whereby the frequency of the input signal does not determine the length of the arcuate segments connecting the four ports.

SUMMARY OF THE INVENTION

This invention comprises a series of pi type networks and coupled line segments, all to a common ground joined in a ring configuration to provide a 180° phase shifted output signal at two of the ports from a single electrical input signal coming in from one other port. The structure can best be described by looking at it from port to port. In the ring structure, there is provided an input port. This input port receives the input signal of predetermined frequency. Upon entering the input port, the input signal will split and move along the transmission ring structure in opposite directions from the input port. The first output signal will move through the first arcuate segment which connects the input port and the first output port. The second output signal will issue from the second output port after traveling along the arcuate segment from the input port to the second output port. The structure has an intermediate port which is located at a point on the transmission line ring structure electrically equidistant from the first output port and the second output port. If the intermediate port is used as an input port the input signal of predetermined frequency will provide two equal output signals at the output ports. In one embodiment of this invention, the segment which connects the input port and the first output port is a simple pi type transmission line network. The simple pi type network will phase shift an amount, $\theta$, in one direction the input signal from the input port, dependent upon the electrical length of the transmission line segments. The segment which connects the input port and the second output port is a coupled line segment. This coupled line segment will achieve a $180° + \theta$ phase shifted output signal. The segments which interconnect the first output port and the intermediate port and the second output port and intermediate port are also simple pi type networks. The present device has reduced the complexity of the ring structure by utilizing two shorted stubs at the first output port and the intermediate port and these can be combined into one shorted stub. The shorted stubs at the input port and the second output port of the pi type networks as we have previously described can be combined into the even mode characteristic impedance of the shorted coupled line section. These pi type networks and shorted coupled lines can be incorporated into this hybrid ring structure. An input signal of predetermined frequency entering the input port will result in power split evenly between the two output ports and a 180° phase difference between the two output ports independent of frequency. Also, isolation is maintained between the two output ports and also the input and intermediate ports independent of frequency. An input signal entering the intermediate port results in even power split, perfect isolation and 0° phase difference. Also, by the symmetry of the structure, the two output ports can be regarded as input and intermediate ports. This is because the path length from the first output port to the second output port via the intermediate port is exactly 180° out of phase with the path from the first output port to the second output port via the input port. The fact that isolation between the opposite ports is independent of frequency can be used to reduce the size of the structure under certain conditions. Impedance loads at each port of the ring should be electrically the same in the band of interest. For example, if the reactive part of the load impedance is capacitive, shortening the length of each transmission line element from a quarter wavelength at band center in the ring structure compensates for the impedance mismatch. The reactance may be inherent to the device to which the ring is connected such as the input or output of a field effect transistor or may be deliberately added. This size reduction can be significant and in turn makes this new hybrid ring structure an ideal candidate for monolithic microwave integrated circuitry.

The disclosed 180° hybrid tee requires photo engraving on one side of a substrate only. Via holes (plated through holes to ground) are required in order to achieve the grounding points for the coupled line segments and shunt transmission line segments. There is considerable flexibility in designing the hybrid with the use of lumped reactive impedance matching elements. For monolithic circuits, a very compact design has been presented in this application which is suitable for direct connection to the input gate terminal of field effect transistors.

$\theta$ is the electrical length and the phase shift for the input signal produced by that line length. If a $\lambda/4$ electrical line length is utilized, it will produce a 90° phase shift. Use of two line segments produces the 180° phase shift.

BRIEF DESCRIPTION OF THE DRAWINGS

For a better understanding of the invention, reference may be had to the preferred embodiment exemplary of the invention shown in the accompanying drawings in which.

DESCRIPTION OF THE PREFERRED EMBODIMENTS

Figure 1A:
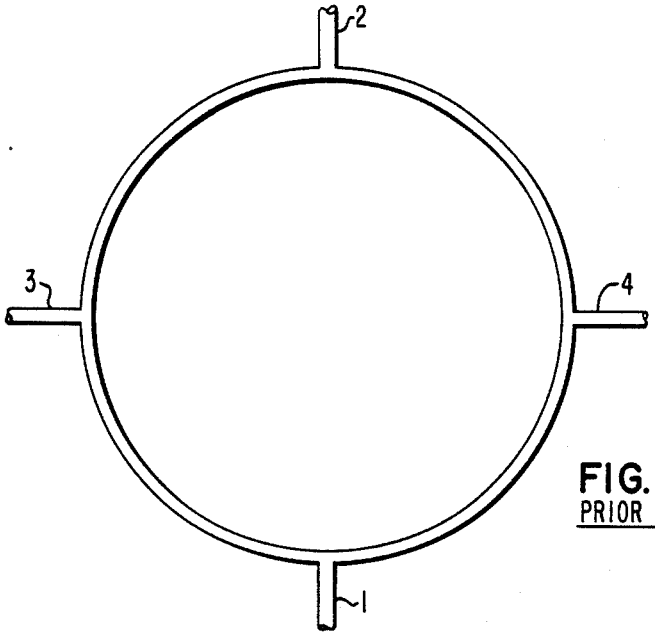
FIG. 1A PRIOR ART
FIG. 1A is a schematic representation of a prior art rat race structure.

FIG. 1A is a schematic representation of the prior art, a coaxial cable "rat race".

Figure 1B:
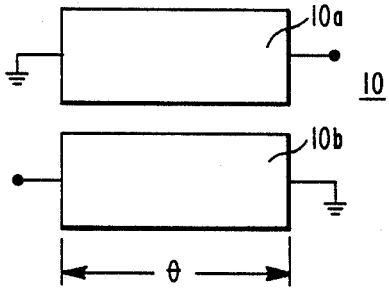
FIG. 1B is a plan view of the arrangement of the coupled line segment.

FIG. 1B is a building block for this reduced size ring structure. The coupled line segment 10 comprises 10*a*, which may be expressed mathematically by the character $Z\phi_E$ and 10*b*, which may be expressed mathematically $Z\phi_0$, "$\theta$" is the electrical length of the coupled line segment.

Figure 1C:
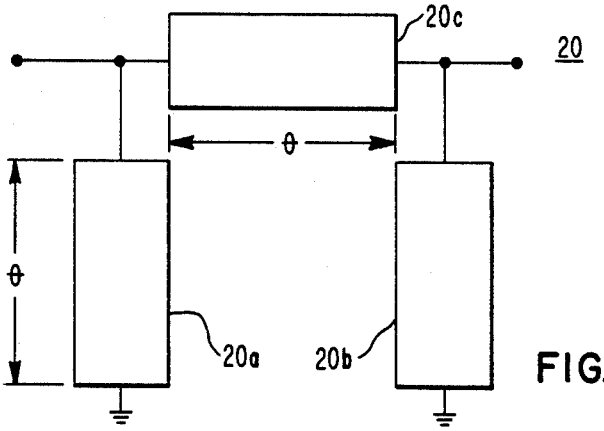
FIG. 1C is a simple pi type network structure.

FIG. 1C is another building block of the ring structure, the equivalent pi type circuit 20. The parallel impedances, 20*a* and 20*b* may be described mathematically by the character $Z\phi_E$. The shunt impedance as shown in FIG. 1C as 20*c* is a characteristic impedance. The characteristic impedance value for 20 C may be found mathematically by utilizing the values for $Z\phi_E$ and $Z\phi_o$. The following mathematical expression, may be used to calculate the characteristic impedance, 20 C:

$$\text{Characteristic Impedance} = \frac{2}{\frac{1}{Z\phi_o} - \frac{1}{Z\phi_E}}.$$

Figure 2:
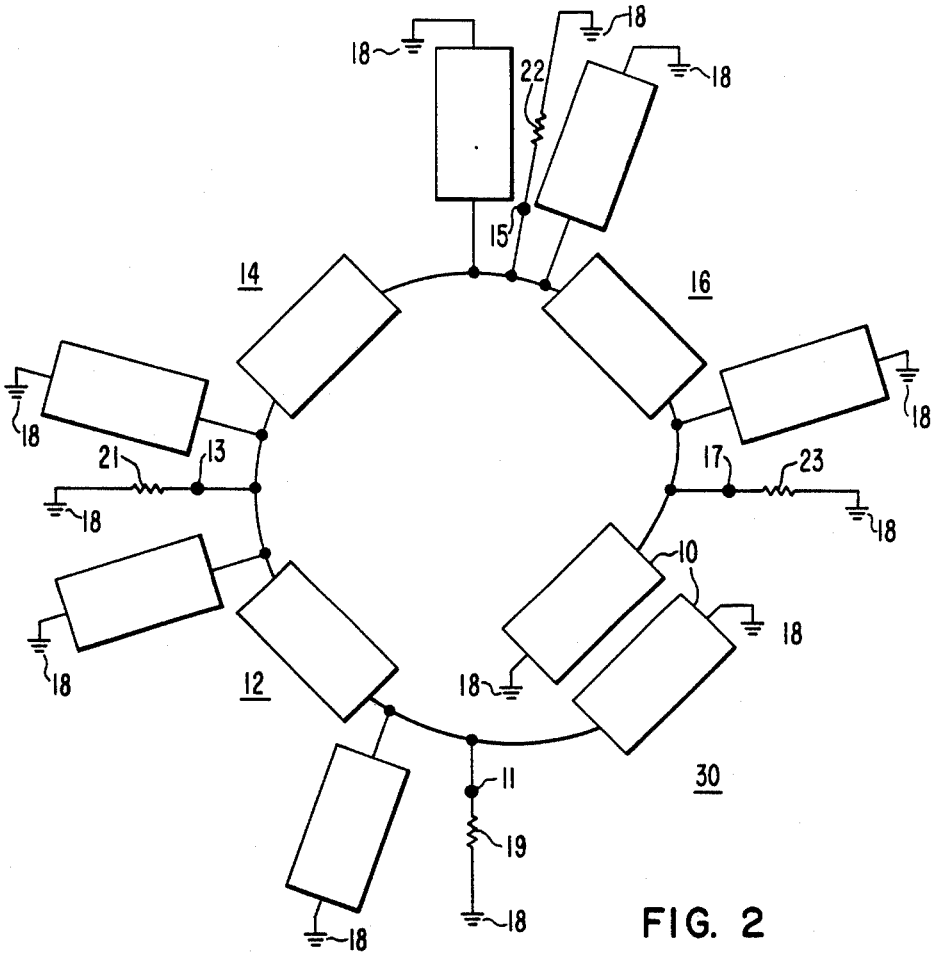
FIG. 2 is a plan view of the three interconnected pi type networks and coupled line segment forming the transmission line ring structure.

FIG. 2 demonstrates the new hybrid ring structure 30. This hybrid ring structure comprises firstly, a coupled line segment 10 which is identical to the coupled line segment as shown in FIG. 1B. Both halves of the coupled line segment go to common ground 18. The transmission line ring structure 30, comprises a first segment 12 which is a simple pi type network an input port 11, a first output port 13, a second pi type network 14, an intermediate port 15, a third pi type network 16 and a second output port 17. Connected at each of the ports 11, 13, 15, and 17 are load impedances 19, 21, 22, 23 which also go to common ground 18. These load impedances will be represented mathematically by the expression $Z_L$. Further, in this ring structure, each shunt transmission line characteristic impedance is mathematically represented by the symbol $Z_s$ which is also equal to $Z_{oe}$. The impedance of the transmission lines connecting the ports is given by $$Z_R = \frac{2}{\left(\frac{1}{Z\phi_O} - \frac{1}{Z\phi_E}\right)}.$$

Figure 3:
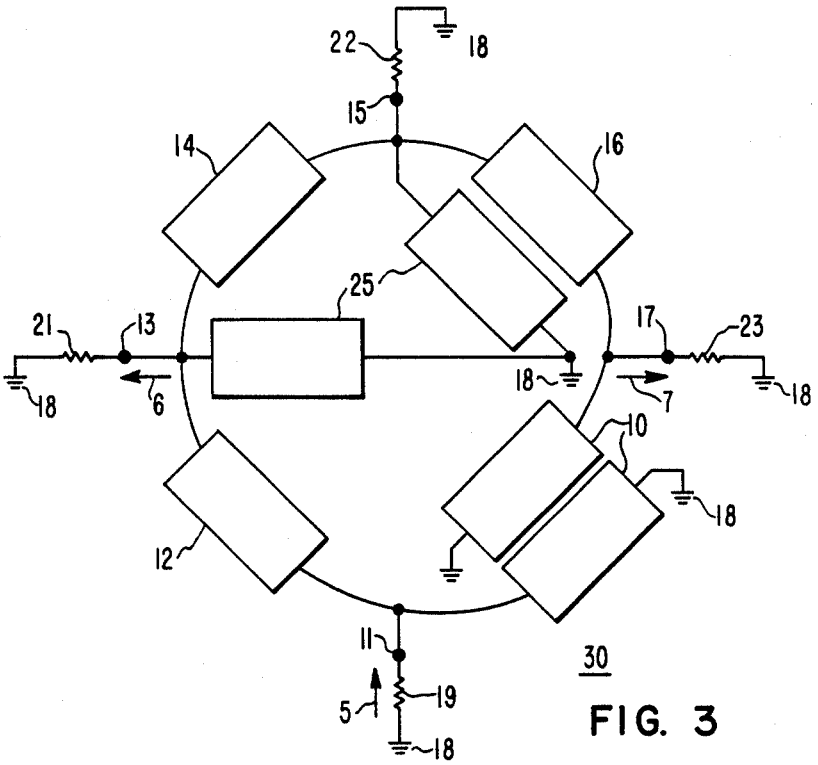
FIG. 3 is a plan view of the reduced circuit transmission line ring structure utilizing coupled line segments and shorted grounded impedances.

FIG. 3 represents a simplified version of this complex transmission line ring structure 30. The coupled line segments are shown as 10, one end of each portion of coupled line segments 10 goes to ground 18. Also, the ungrounded end of one portion of coupled line segment 10 is connected to input port 11. The ungrounded end of the remaining portion of the coupled line segments 10 is connected to second output port 17. The first load impedance which interconnects the input port 11 and common ground 18 is the input load impedance 19. The second load impedance which interconnects the first output port 13 and ground 18 is second output port load impedance 21. The third load impedance which interconnects the intermediate port 15 and ground 18 is the intermediate load impedance 22, and the fourth load impedance which interconnects the second output port 17 and ground 18 is the second output load impedance 23. The first transmission line 12 is connected between the input port 11 and the first output port 13. The second transmission line 14 is connected between the first output port 13 and the intermediate port 15. The third transmission line 16 is connected between the intermediate port 15 and the second output port 17. The shorted coupled line segments 10 are connected between the input port 11 and the second output port 17. The shorted grounded stubs which are connected between the first output port 13 and ground 18 and also the intermediate port 15 and common ground 18 are so interconnected to the ring structure that they provide a common impedance shared between the first pi type network 12, the second pi type network 14 and the third pi type network 16. Input signal 5 of a predetermined frequency enters input port 11. A signal split occurs at the input port 11. The input signal 5 moves between input port 11 through first pi type network 12 towards the first output port 13 through the first output load impedance 21 to common ground 18. This same input signal 5 upon entering input port 11 also moves along the transmission line ring structure towards the second output port 17 through the coupled line segment 10 which interconnects input port 11 and second output port 17. Upon exiting from second output port 17, the second output signal 7 travels through the second output load impedance 23 to common ground 18. Input signal 5 after entering input port 11 and travelling through the first pi network 12 is phase shifted $\theta$ in one direction. This first output signal 6 then exits through the first output port 13 as a signal which is $\theta$ phase shifted from the signal which entered the input port 11. The second output signal 7 which exits at the second output port 17 is due to its passing through the coupled line segment 10 is phase shifted $180°+\theta$. This results in the first output signal 6 and the second output signal 7 being 180° out of phase. The second pi type and third pi type networks 14, 16 which connects the first output port 13 and the intermediate port 15 and the intermediate port 15 and second output port 17 provide isolation for the first output signal 6 and the second output signal 7. This isolation occurs because of the 180° phase shift which occurs between first output port 13 and second output port 17 along this route of the transmission line ring structure. By developing ABCD matrices for both of the coupled line segments 10 and the various pi type networks, first pi network 12, second pi type network 14, third pi type network 16 and their interrelation with the shorted grounded impedances 25, it can be seen that the interconnected networks are exactly equivalent for all frequencies except that the transmission phase difference between the the coupled line segment circuits and the pi networks, is exactly 180°.

For the pi type network the ABCD matrix is:

$$\begin{bmatrix} A & B \\ \text{pi} & \\ C & D \end{bmatrix} = \begin{bmatrix} 1 & 0 \\ \frac{Yoe}{j\tan\theta} & 1 \end{bmatrix} \cdot \begin{bmatrix} \cos\theta & \frac{j2\sin\theta}{(Yoo - Yoe)} \\ \frac{(Yoo - Yoe\sin)\theta}{2} & \cos\theta \end{bmatrix} \cdot \begin{bmatrix} 1 & 0 \\ \frac{1Yoe}{j\tan\theta} & 1 \end{bmatrix}$$

$$= \begin{bmatrix} \frac{(Yoo + Yoe)}{(Yoo - Yoe)} \cos\theta & \frac{j2\sin\theta}{(Yoo - Yoe)} \\ \frac{(Yoo + Yoe)^2\cos^2\theta - (Yoo - Yoe)^2}{j2\,(Yoo - Yoe)\sin\theta} & \frac{(Yoo + Yoe)}{(Yoo - Yoe)} \cos\theta \end{bmatrix}$$

The ABCD matrix of the shorted coupled line section is calculated from the Y parameters as:

$$\begin{bmatrix} A & B \\ \text{coupled} & \\ C & D \end{bmatrix} = \begin{bmatrix} -\frac{(Yoo + Yoe)}{(Yoo - Yoe)} \cos\theta & -\frac{j2\sin\theta}{(Yoo - Yoe)} \\ -\frac{(Yoo + Yoe)^2\cos^2\theta + (Yoo - Yoe)^2}{j2(Yoo - Yoe)\sin\theta} & -\frac{(Yoo + Yoe)}{(Yoo - Yoe)} \cos\theta \end{bmatrix}$$

Therefore, $$\begin{bmatrix} A & B \\ \text{Pi} & \\ C & D \end{bmatrix} = \begin{bmatrix} -1 & 0 \\ 0 & -1 \end{bmatrix} \begin{bmatrix} A & B \\ \text{coupled} & \\ C & D \end{bmatrix}$$

so that the pi type network of the transmission lines is equivalent to the shorted coupled line section proceeded by an ideal phase reversing transformer. This result is independent of the electrical length $\theta$ of the two networks and thus independent of frequencies. The two networks behave identically as bandpass filters. The pi type networks 12, 14, 16 and their dual coupled shorted lines 10 can be incorporated into the new hybrid ring structure of FIG. 3. This new hybrid ring structure as mentioned previously in the Description of the Prior Art is similar in appearance to the reverse phase hybrid ring or one $\lambda$ ring as described in the article entitled, "A Wideband Stripline Hybrid Ring", authored by Steven March, for the June 1968 IEEE Transactions on Microwave Theory and Techniques, page 361 . This new hybrid ring structure can be distinguished from the hybrid ring structure described in the June 1968 IEEE Transactions article authored by Steven March, by the addition of the shorted stubs 25 at the first output port 13 and the intermediate port 22 as shown in FIG. 3. The addition of these stubs 25 enables many properties of the new ring to be theoretically totally frequency independent. Specifically, for all frequencies, the insertion loss is identical for all adjacent ports. The input reflection coefficients are identical for all four ports 11, 13, 15 and 17. Opposite ports are totally isolated. Transmission phase is identical for input port 11 at the first output port 13 with output ports opposite each other and the transmission phase difference will be exactly 180° for inputs at the input port 11 or the input port 17 which can also serve as an input port although in the first description, it was the second output port. The only frequency limiting aspects of this disclosed ring are in their inability to match the four ports to load impedances and some minor parasitic affects associated with the actual layout, for example, via hole inductances or junction effects wherever three lines are in some way interconnected. This hybrid ring structure 30 is more manufacturable than the reverse phase hybrid ring as described by March. The stub impedances Zs as defined earlier at the input port and at the second output port into the coupled lines of 10 are incorporated into the even mode impedance Zϕe. As shown in FIG. 3 decreasing Zϕe results in the physical width of the coupled lines increasing. As the line widths of the coupled line sections 10 are increased for a given gap spacing, the odd mode impedance of the section is lowered. Therefore, the coupled line section 10 can be made with wider gaps and lines than the ring without the stubs as shown in the March article. The coupled line section of the earlier ring as taught by March is very difficult to manufacture due to very narrow coupling gaps and this limit accounts for the limited use of the March design λ ring to date.

In summary, the new ring can be smaller than the other hybrid rings because the 180° transmission phase difference of the networks as shown in FIG. 1 was obtained independent of their electrical length $\theta$. The bandpass response of the filter networks of FIG. 3 that comprise the ring can be widened by utilizing additional impedance matching elements to make higher order filters. Of particular advantage is shortening the line lengths as shown in FIGS. 1, 2 and 3 from a nominal ¼ wavelength and utilizing high pass impedance matching elements, for example, series capacitors and shunt inductors to tune the lower band edge response. The additional matching circuitry is incorporated just outside the ring structure at each port and the result is a ring structure with significantly improved performance, reduced size and minimal complexity. The design of the ring depends on the desired filter response and other considerations such as overall size and component count. Thus, the variations may include ring sections of lengths much less than ¼ wavelength with impedance matching circuitry or ring sections of ¼ wavelength with no impedance matching circuitry or ultra wide band versions with ring sections of length of ¼ wavelength at the band center with impedance matching circuitry for upper and lower band edges. Computer aided design techniques allow rapid determination of the optimum design. This makes the new hybrid ring structure an ideal candidate for monolithic microwave integrated circuitry.

Figure 4A:
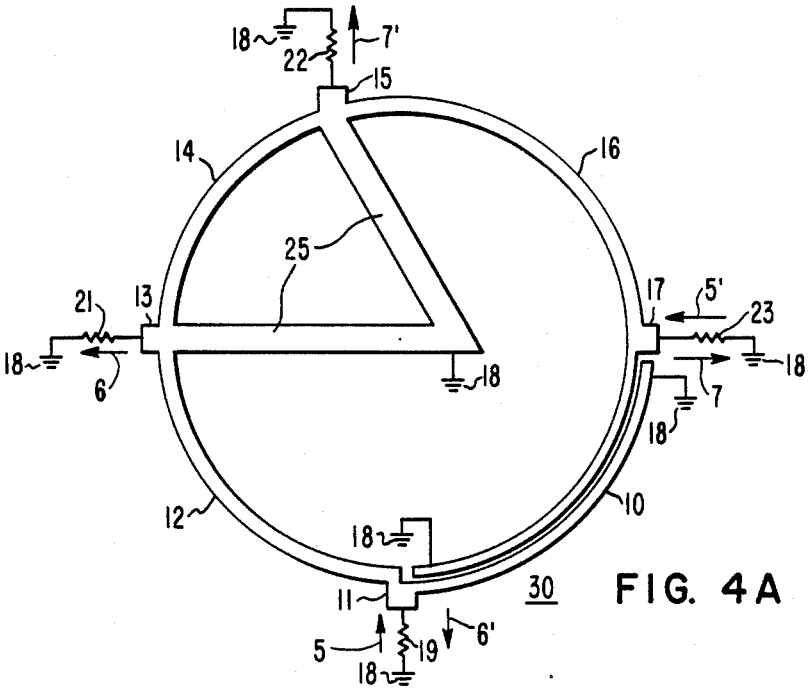
FIG. 4A is a plan view of the transmission line ring structure.

The versatility of this new design can be seen with the several hybrid tee configurations that have been analyzed for this invention in the 8 to 12 gigahertz band. FIG. 4A shows a transmission line ring structure 30 in the preferred embodiment with input port 11, load impedance input 19 to common ground 18. The first line segment connects the input port 11 to the first output port 13. The input signal 5 enters through input port 11. The first output signal 6 which exits from the first output port 13 through load impedance output port 21 to common ground 18 is placed on this transmission line ring structure 30 directly opposite the second output port 17 wherein this split input signal 5 partially passes through the coupled line segments 10 which again are arcuate line segments to the second output port 17 through the second output port impedance 23 to common ground 18. In this transmission line ring structure 30 isolation and phase shift is again provided by the second and third pi type networks 14 and 16, respectively, which are interconnected between the first output port 13 and the intermediate port 15 and the intermediate port 15 and the second output port 17.

The input signal 5 need not necessarily go through the input port 11. The input signal 5 which can be called 5' may also enter in through the port 17 thereby again splitting between the coupled line segments 10 and the pi type network 16. The first output signal will be 6' which will exit out of what was input port 11 which now may be renamed the first output port 13' and there is shown a second output signal 7' which may be transmitted via what was the intermediate port 15 which will now be the second output port 17'. Again, the function will remain the same and that is the generation of two isolated 180° phase shifted output signals 6', and 7' from a single input signal 5'.

FIG. 4A also demonstrates the load impedances 19, 21, 22, 23 for this design may be, for example, a 50 ohm resistor. For example, using a 50 ohm resistor design for the load impedances with interconnected arcuate and straight line segments equal to a quarter wavelength in length, the performance or the power split and phase difference between the first output port 13 and the second output port 17, the VSWR and the isolation are all very good over the design bandwidth of 8 to 12 gigahertz. For this design, the total ring circumference 30 is four times ¼ wavelength equals the wavelength or approximately 0.48 inches (1.190 cm.) at 10 gigahertz. The gap in the coupling region 10 is relatively small, for example, 0.005 inches (0.0124 cm.) but this coupler 10 could be fabricated as a Lange type (interdigitated) coupler to make it more realizable. This design is relatively large but would be very useful for hybrid circuits where packaged FETs could be used in the amplifier.

Figure 4B:
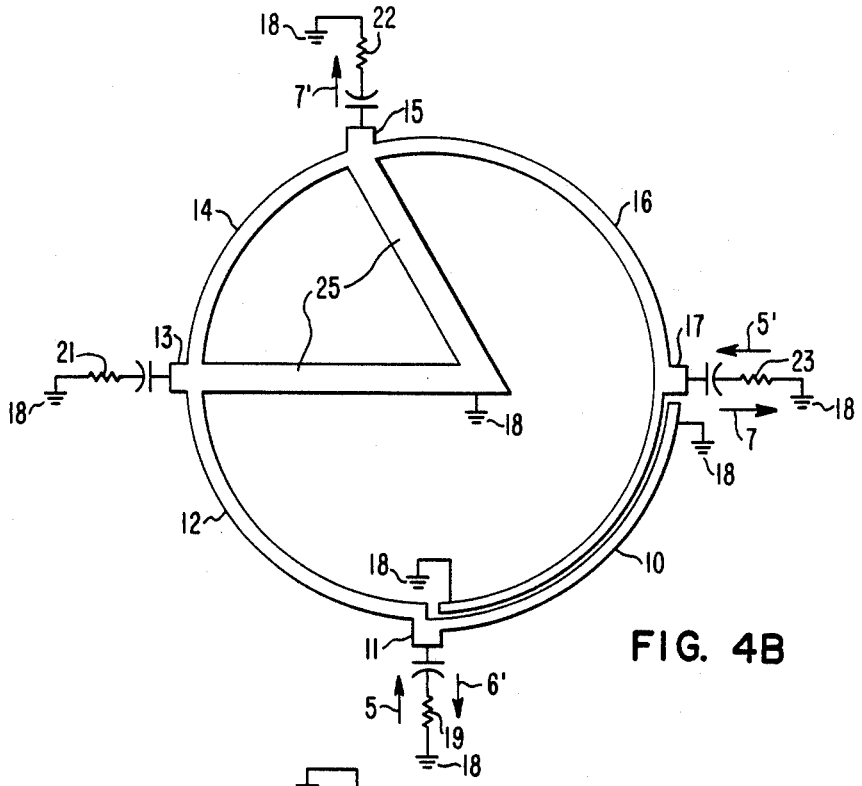
FIG. 4B is a plan view of the transmission line structure utilizing load impedances distinct from FIG. 4A.

A reduced size magic tee is shown in FIG. 4B. In this version of the hybrid rat race, a 0.91 picofarad capacitor has been added in series at each port of the ring structure input port 11, first output port 13, intermediate port 15, and second output port 17 in series with the load impedances which were the resistors. The utilization of a capacitor has two desirable effects, (1) the interconnecting arcuate and linear line segments are reduced to approximately 77° (0.03 inches, 0.0744 cm.) and (2) the bandwidth is improved to over an octave, for example, the frequency range for which the input VSWR is less than 1.5 to 1 is approximately 6.5 to 13.5 gigahertz as compared to 8 to 12 gigahertz for the design as shown in FIG. 4A. The power split and isolation will be excellent for this increased bandwidth and the design will have rather tight couplings which necessitate using an interdigitated type coupler in the coupled section 10.

Figure 4C:
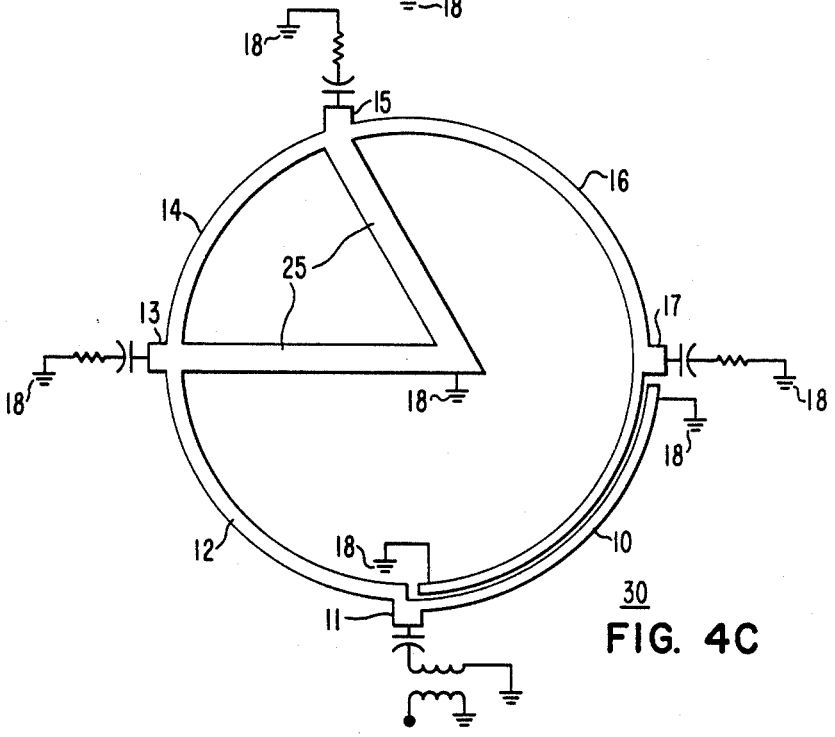
FIG. 4C is a plan view of the transmission line ring structure.

FIG. 4C is yet another configuration or preferred embodiment of the reduced size magic tee 30. Here there is realized the improvement of further reduced size and manufacturability. The interconnecting arcuate and linear coupled segments have been reduced to approximately 70° or (0.093 inches, 0.231 cm.). The coupling gap has been increased to 0.0015 inches (0.0037 cm.). Performance is still excellent over the 7 to 13 gigahertz range. An important application of this hybrid tee is illustrated in FIG. 4C which demonstrates the 180° junction for monolithic circuits that is designed for direct connection to the gate circuits of the two 1200 micrometer FETs as represented on this structure as the 5 ohm resistor and the 1.2 picofarad capacitor. Note that for this application, the interconnecting lines have been reduced to only 0.037 inches (0.0918 cm.). Hence, the overall size of the ring structure is small. Matching circuitry is required to transform the 5 ohm input impedance level to that of the input port. However, such matching circuitry is normally required at the input of each FET where the hybrid tee is fabricated even in the 50 ohm format. Note that all line widths are reasonable and that the 0.5 mil coupling gap is easily achieved in monolithic circuits fabricated on gallium arsenide. The performance of this design as illustrated in FIG. 4C is very good over the 8 to 12 gigahertz range.

Figure 5A:
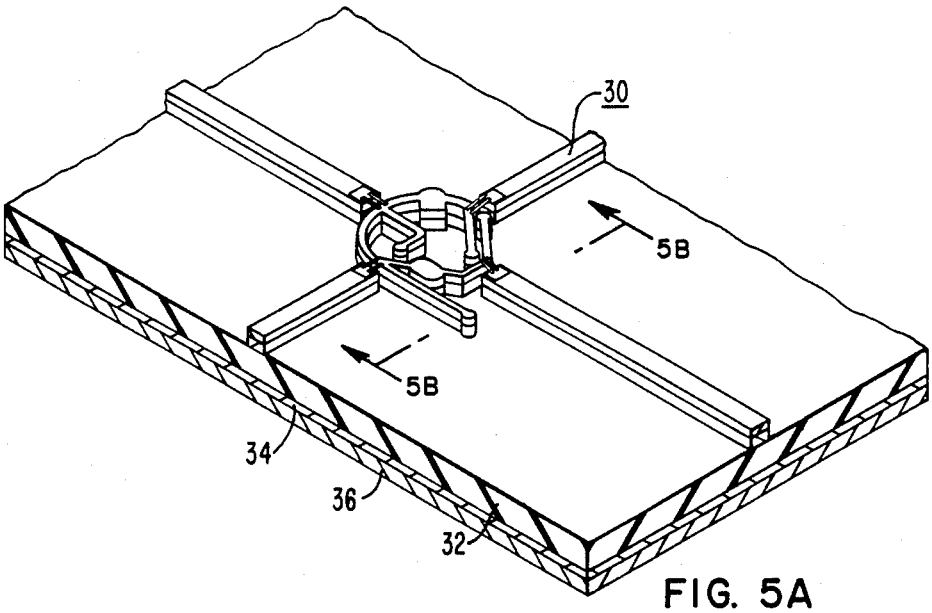
FIG. 5A is a plan view of the preferred embodiment of a phase shifting device on a ceramic substrate base.

FIG. 5A shows the transmission line ring phase shifting structure 30 as it would appear on an actual application. The transmission line ring structure 30 rests upon a layer of semi-insulating or insulating material 32 which in turn on the adjacent side has been layered with the layer of evaporated metal or metallic conductive material 34 and that in turn has been plated with the same metal or metallic conductive material. For example, a semi-insulating substrate 32 of ceramic could be used with an evaporative layer of gold 34 and in turn a layer 36 of gold. The structure itself as it will be layered upon the substrate is shown in FIG. 5B.

Figure 5B:
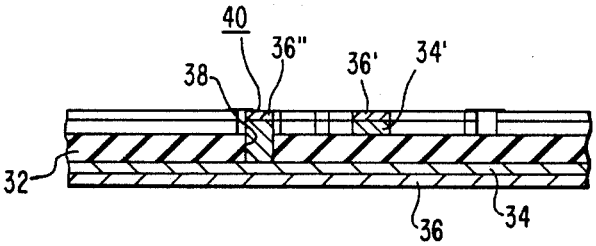
FIG. 5B is a cross section view of the manufactured phase shifting device.

In FIG. 5B, there is shown firstly, a layer of semi-insulating material 32 which could be, for example, ceramic, fiberglass Duroid, gallium arsenide or aluminum oxide, utilized as the substrate layer. Upon the one face of the substrate layer 32, a layer of conductive material 34 such as copper, gold, or silver is evaporated upon the ceramic substrate 32. A gold plating or other electrically conductive material layer 36 is layered upon the conductive material 34 forming a conductive layer sandwiched upon the ceramic 32. The actual transmission line ring structure 30 would first be layered upon the opposing face of the insulating substrate 32 utilizing a well-known photolithographic technique of the evaporation forming a layer 34' of chrome or chrome gold upon the ceramic layer 32. That layer 34', in turn, is plated with a conductive material 36', i.e. gold or silver foil to prepare the grounds which will be utilized in the structure. Via holes 38 are cut through the insulating material 32 to contact with the foiled layer 34 and plated layer 36.

Figure 5C:
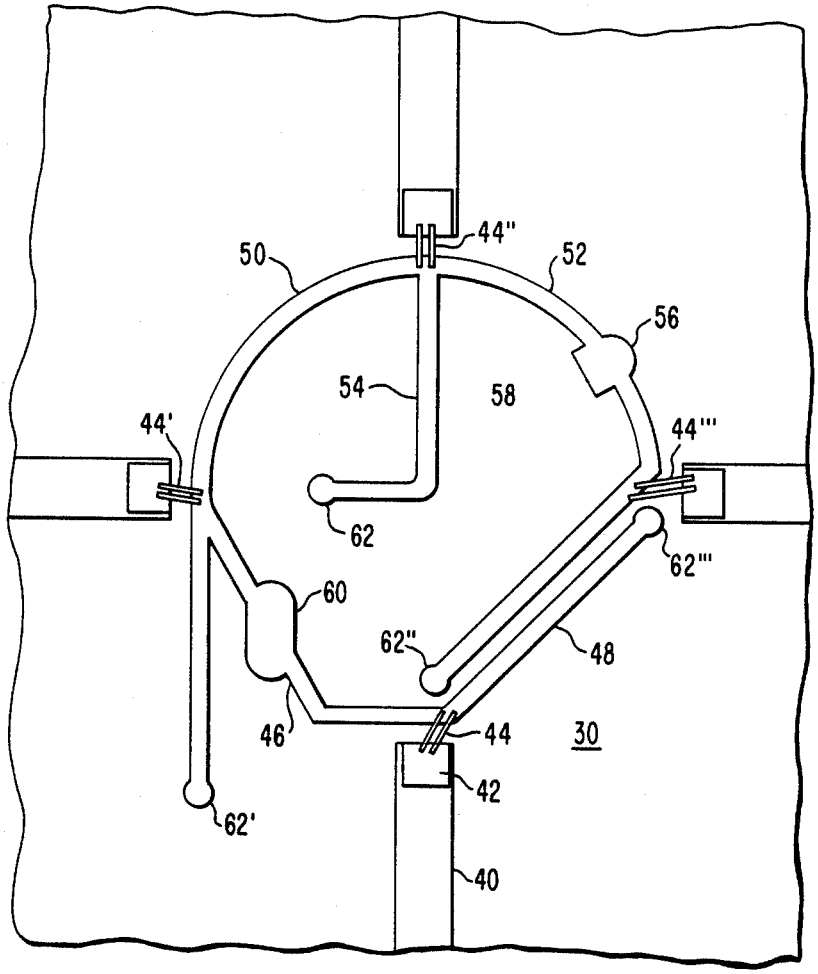
FIG. 5C is a plan view of the manufactured line ring structure.

FIG. 5C is a plan view of the actual manufactured preferred embodiment of this device. The microstrips which will be the interconnection between the device transmission line 30 and the peripheral load impedances and input and outputs will be matched to the input frequency. Bonding pads 42 appear on all four terminal strips 40 and bonding wires 44 interconnect the transmission line ring structure 30 to the bonding pads 42 and in turn, the strip line 40. The structure remains functionally the same. A first arcuate segment which interconnects the first wire bond 44 to the second wire bond 44' is the first pi type network which is designated as 12 in the prior figures. Areas of increased width 56 and 60, on arcuate segments 52 and 46, respectively comprise gold solder. The widths of areas 56 and 60 are dependent upon the tuning requirements of the hybrid tee and are determined at the time of manufacture via experimentation with the completed tee. The second arcuate segment which interconnects 44' to 44'' is arcuate segment 50 which is the second pi type network which is designated as 14 on the prior figures. The third arcuate or pi type network 52 represents the third pi type network which was designated as 16 and interconnecting between 44'' and 44'''. The coupled line segments are comprised of parallel segments 48. The shorted stub segment 54, which again interconnects what was previously termed the intermediate port 15 in FIGS. 2, 3, **4*a*, 4*b*, and 4*c* and ground 62 is functionally commonly shared among the three arcuate line segments 46, 50, and 52. The common ground of this structure is 62, 62', 62'' and 62''' which are via holes 38 going through the substrate 32 to the ground conductive metal 34 and 36**.

Numerous variations may be made in the above-described combination and in different embodiments of this invention may be made without departing from the spirit thereof, therefore, it is intended that all matter contained in the foregoing description and in the accompanying drawings shall be interpreted as illustrative and not in a limiting sense.

We claim:

1. A signal phase shifting apparatus comprising a transmission line ring structure which provides two independent, isolated, 180 degree phase shifted output signals from a single electrical input signal of a predetermined frequency;

an input port means coupled onto said transmission line ring structure and operable to receive said single electrical input signal of said predetermined frequency;

a first output port means coupled onto said transmission line ring structure and operable to transmit a 90 degree phase shifted electrical input signal as a first electrical output signal, said single electrical input signal being phase shifted 90 degrees in a first direction;

an intermediate port means coupled onto said transmission line ring structure and operable to provide isolation for said first 90 degree phase shifted input signal in said first direction and a second phase shifted output signal;

a second output port means coupled onto said transmission line ring structure and operable to transmit said second phase shifted output signal 90 degrees and in a second direction, said second direction being opposite of said first direction;

a first pi type network means comprising a first quadrant of said transmission line ring structure and operable to provide said 90 degree phase shift in said first direction of said single electrical input signal entering said input port means;

a second pi type network means comprising a second quadrant of said transmission line ring structure, said second pi network means operable to provide isolation for said first 90 degree phase shifted output signal;

a third pi type network means comprising a third quadrant of said transmission line ring structure and operable to provide further signal isolation for said first and said second 90 degree phase shifted output signals;

a coupled line segment means comprising a fourth quadrant of said transmission line ring structure and operable to provide said second 90 degree phase shift of said split signal input signal entering from said input port in said second direction, said fourth quadrant further comprising, a shared pair of transmission line segments, a first end of said transmission line segments interconnected between each of said first output port means and said intermediate port means, said coupled line segment means having a second end opposing said first end of said coupled line segment means, said second end coupled together to each other and to ground, operable to serve as ground of said first, said second, and said third pi type networks.

2. The signal phase shifting apparatus as set forth in claim 1, wherein said input port means and said intermediate port means are interchangeable, and said intermediate port means is operable to receive said input signal and said output signals are so produced to be equal and zero degrees phase shifted.

3. The signal phase shifting apparatus as in claim 1 wherein said transmission line ring structure comprises electrically conductive material.

4. The signal phase shifting apparatus as in claim 1 wherein said transmission line ring structure comprises an evaporated layer of gold.

5. The signal phase shifting apparatus as in claim 1 wherein said input port, first output port, second output port and intermediate port means comprise wire bond means.

6. The signal phase shifting apparatus as in claim 1 wherein said first, said second and said third pi type network means comprises electrically conductive material in an arcuate configuration interconnecting said input port, said first output port, said intermediate port and said second output port means.

7. The single phase shifting apparatus as in claim 6 wherein said arcuate configuration of electrically conductive material further comprises an evaporated layer of gold.

8. The signal phase shifting apparatus as in claim 1 wherein said coupled line segment means comprises two linear electrically conductive material coupled line segments so positioned upon said transmission line ring structure so as to be parallel one to the other, extended between said second output port and said input port.

9. The signal phase shifting apparatus as in claim 1 wherein said coupled line segment means comprises said two linear electrically conductive parallel segments, said two linear electrically conductive parallel segments further comprised of gold.

10. The signal phase shifting apparatus as in claim 1 wherein said input port means is coupled to said transmission line ring structure at a point directly opposite said intermediate port means.

11. The signal phase shifting apparatus as in claim 1 wherein the first output port means is coupled to said transmission line ring structure at a point on the said structure directly opposite said second output port means.

12. The signal phase shifting apparatus as in claim 1 wherein said input port, second output port, first output port and intermediate port means are all positioned upon said transmission line ring structure to be one-quarter wavelength distant from each other.

13. A microwave phase shifter apparatus for providing frequency independent isolated 180 degree phase shifted output signals from a single electrical input signal having a predetermined wavelength, comprising:

a transmission line ring structure of a circular configuration;

an input port coupled to said transmission line ring and also coupled through a first load impedance to ground;

a first output port coupled to said transmission line ring structure and also coupled to a second load impedance and to ground, said first output port located on said ring structure no further than one-quarter wavelength distant from said input port;

a second output port coupled to said transmission line ring structure and also coupled through a third load impedance to ground, said second output port located on said ring structure directly opposite said first output port;

an intermediate port coupled to said transmission line ring structure and also to a fourth load impedance to ground, said intermediate port physically located on said ring structure directly opposite said input port and at a point one-quarter wavelength distance from said first output port and said second output port;

a first pi type network means coupled to said transmission line ring structure at a point on said ring structure between said input port and said first output port to provide a first predetermined amount of phase shift of the input signal entering said input port;

a second pi type network means coupled to said transmission line ring structure at a point on said ring structure between said first output port and said intermediate port to provide signal isolation for said predetermined amount of said phase shifted input signal at said first output port;

a third pi type network means coupled to said transmission line ring structure at a point on said ring structure between said intermediate port and second output port to provide signal isolation for said predetermined amount of said phase shifted input signal at said second output port;

a coupled line segment coupled to said transmission line ring structure and to ground, said coupled line ring segment located at a point on said ring structure between said input port and said second output port and further coupled to said input port and said second output port to provide a second predetermined amount of phase shift of said input signal entering said input port, said first predetermined amount of phase shift of said input signal entering said input port and said second predetermined amount of phase shift being of equal amounts of phase shift; and, a shorted stub impedance network means coupled to said transmission line ring structure and to ground at said first output port and at said intermediate port, said shorted stub impedance network shared during operation between said first, second and third pi type networks.

14. A microwave shifter apparatus as in claim 13 wherein said transmission line ring structure of a circular configuration comprises electrically conductive material.

15. The transmission line structure of a circular configuration as in claim 14 wherein said electrically conductive material comprises gold.

16. A microwave phase shifter apparatus as in claim 13 wherein said input port, said first output port, said intermediate port, and said second output port comprises a wire bond means of conductive material.

17. A microwave phase shifter apparatus as in claim 13 wherein said first, second and third pi type network means comprises an arcuate configuration of electrically conductive material.

18. A microwave phase shifter apparatus as in claim 13 wherein said coupled line segments and said shorted stub impedance network means further comprises electrically conductive material.

19. A phase shifting device capable of producing distinct, isolated, 180° phase shifted electrical output signals from a single electrical input signal of predetermined frequency, comprising:

a ground plane electrode means comprising electrically conductive material and operable to provide a common ground for said phase shifting device;

an insulating substrate layer means overlaying said ground plane electrode means and operable to support said phase shifting device;

a phase shifting electrically conductive structure operable to produce a first and a second 90° phase shifted electrical output signal from a single electrical input signal of predetermined frequency, said phase shifting structure comprising:

a conductive ring structure of circular configuration, an input wire bond means coupled to said conductive ring structure and operable to receive said input signal of predetermined wavelength, a first output wire bond means coupled to said conductive ring structure at a location no more than one-quarter wavelength distant from said input wire bond means and operable to transmit said first 90° phase shifted output signal;

an intermediate wire bond means coupled to said conductive ring structure at a location no more than one-quarter wavelength distant from said first output wire bond means and operable to provide signal isolation for said first 90° phase shifted output signal, a second output wire bond means coupled to said conductor ring structure at a location no more than one-quarter wavelength distant from said intermediate wire bond means and said input wire bond means, a first arcuate electrically conductive segment means extending between said input wire bond means and said first output wire bond means and operable to provide a 90° phase shift of said electrical input signal in one direction, a second arcuate electrically conductive segment means extending between said first output wire bond means and said intermediate wire bond means and operable to provide isolation for said first 90° phase shifted output signal in one direction, a third arcuate electrically conductive segment means extending between said intermediate wire bond means and said second output wire bond means and operable to provide signal isolation for said 90° phase shifted output signal in the opposite direction, a first linear electrically conductive coupled line segment extended from said second output wire bond means towards said input wire bond means and connecting to said common ground, a second linear electrically conductive coupled line segment extended from said input wire bond means towards said second output wire bond means and connected to said common ground means, said first and said second linear electrically conductive coupled line segments being operable to provide a 90° phase shift for said input signal of predetermined frequency, a third linear electrically conductive segment extended from said intermediate wire bond means and connected to said common ground means, a fourth linear electrically conductive segment means extended from said first output wire bond means to said common ground means, said third and said fourth linear electrically conductive segment means being coupled and operable to provide common grounded coupled conductive segments for said first, second and third arcuate segments;

a first bonding pad means coupled to said input wire bond means and operable to receive said input signal;

a second bonding pad means coupled to said first output wire bond means and operable to receive said first 90° phase shifted output signal in one direction;

a third bonding pad means coupled to said intermediate wire bond means and operable to provide signal isolation between said first and said second 90° phase shifted output signal;

a fourth bonding pad means coupled to said second output wire bond means and operable to receive said second 90° phase shifted output signal;

a first linear transmission line segment means interconnected to said first bonding pad means and operable to transmit said input signals;

a second linear transmission line segment means interconnected to said second bonding pad means and operable to transmit said first 90° phase shifted output signal;

a third linear transmission line segment means interconnected to said third bonding pad means and operable to transmit said isolated first and said second output signals; and, a fourth linear transmission line segment means interconnected to said fourth bonding pad means and operable to transmit said 90° phase shifted output signal all of this further producing a 180° phase shifted set of output signals.

20. A phase shifting device capable of producing 180° phase shifted electrical output signals as in claim 19 wherein said ground plane electrode means comprises evaporated gold and gold/chrome upon a semi-insulating substrate layer.

21. A phase shifting device capable of producing 180° phase shifted electrical output signals as in claim 19 wherein said insulating substrate further comprises a ceramic material.

22. A phase shifting device capable of producing distinct, isolated, 180 degree phase shifted electrical output signals, as in claim 19 wherein said common ground means comprises a view hole drilled and extended from said phase shifting electrically conductive structure through said insulating substrate layer means to said common ground means.

23. A signal phase shifting apparatus for operation in the microwave range which provides two independent isolated predetermined phase shifted output signals from a single electrical input signal of predetermined frequency selected from any of a wide range of microwave frequencies, said apparatus comprising:

a generally circular transmission line ring structure;

an input port means coupled to said transmission line ring structure and connected through an electrical impedance to ground, said input port means operable to receive said input signal;

a first pi type network means connected to said input port means and comprising a first quadrant of said transmission line structure and operable to provide a predetermined phase shift in a first direction of a first portion of said input signal as received at said input port means;

a first output port means coupled onto said transmission line ring structure at the terminus of said first pi type network means and connected through an electrical impedance to ground, said first output port means operable to function as an output port for said predetermined phase shifted first portion of said input signal;

a second pi type network means comprising a second quadrant of said transmission line ring structure;

an intermediate port means coupled onto said transmission line ring structure at the terminus of said second pi type network and connected through an electrical impedance to ground;

a second output port means coupled onto said transmission line ring structure and connected through an electrical impedance to ground;

broadside-coupled line segments connected to ground at opposite ends thereof and comprising a fourth quadrant of said transmission lien ring structure, said broadside-coupled line segments connected between said input port means and said second output port means and operable to provide a predetermined phase shift of a second portion of said input signal as received at said input port means in a second direction which is 180° out-of-phase with said phase-shifted first input signal as developed at said first output port means, and said second output port means comprising an output port for said phase-shifted second portion of said input signal;

a third pi type network means comprising a third quadrant of said transmission line ring structure and connected between said second output port means and said intermediate port means, and said second pi type network means and said intermediate port means and said third pi type network means combining to provide isolation between said first output port means and said second output port means; and a pair of additional stub conductor members, one of said additional conductor members connected at one end to said first output port means and at the other end to ground, the other of said additional conductor members connected at one end to said intermediate port means and at the other end to ground, and said additional stub conductors operating to substantially increase the range of microwave frequencies which can be effectively phase shifted.

* * * * *